US007153048B2

(12) United States Patent
Tabasso

(10) Patent No.: US 7,153,048 B2
(45) Date of Patent: Dec. 26, 2006

(54) MACHINE FOR PRINTING IMAGES ON ARTICLES

(75) Inventor: Giovanni Tabasso, Pino Torinese (IT)

(73) Assignee: Eidos S.p.A., Chieri (IT)

( * ) Notice: Subject to any disclaimer, the term of this patent is extended or adjusted under 35 U.S.C. 154(b) by 37 days.

(21) Appl. No.: 10/512,558

(22) PCT Filed: Apr. 3, 2003

(86) PCT No.: PCT/EP03/03489

§ 371 (c)(1),
(2), (4) Date: Oct. 25, 2004

(87) PCT Pub. No.: WO03/091030

PCT Pub. Date: Nov. 6, 2003

(65) Prior Publication Data

US 2005/0152730 A1 Jul. 14, 2005

(30) Foreign Application Priority Data

Apr. 24, 2002 (IT) ..... TO2002A0356

(51) Int. Cl.
*B41J 2/315* (2006.01)
*B41F 17/00* (2006.01)

(52) U.S. Cl. ..... 400/120.01; 101/35

(58) Field of Classification Search ..... 400/120.01; 101/35, 193, 194, 379
See application file for complete search history.

(56) References Cited

U.S. PATENT DOCUMENTS 4,172,418 A 10/1979 Durand ..... 101/194
5,135,319 A 8/1992 Kobayashi et al. ..... 400/208

*Primary Examiner*—Anthony H. Nguyen
(74) *Attorney, Agent, or Firm*—Sughrue Mion, PLLC

(57) ABSTRACT

The machine (1) comprises a support structure (4, 11) in which there are: a thermal-transfer device (14) having a movable active surface (36*a;* 136*a*) facing the path of the articles; supply and guide means (5–10) suitable for advancing a flexible ribbon (N) in steps along a predetermined route which extends partly between the active surface (36*a;* 136*a*) of the thermal-transfer device (14) and the path of the articles, the flexible ribbon (N) carrying, at predetermined intervals, images formed with a thermally transferable ink; and drive devices (22) suitable for bringing about a vertical movement of the thermal-transfer device (14) towards the ribbon (N) and an article so as to press and heat the ribbon (N) against an article in order to bring about the transfer of an image carried by the ribbon (N). The supply and guide means comprise: three pairs of aligned and parallel guide rollers (R1) disposed on the route of the ribbon (N) on upstream and downstream sides of the thermal-transfer device (14). The arrangement of the pairs of rollers (R1, R2, R3) is such that the portions of the ribbon (N) which are included between the first and second pairs of rollers (R1, R2) and the portions which are included between the second and third pairs of rollers (R2, R3) are substantially parallel with one another. Movement devices (70; 170), associated with the first and with the second pairs of guide rollers (R1, R2), are such that a movement of the second pair of rollers (R2) is substantially equal to half of the corresponding movement of the first pair of rollers (R1).

13 Claims, 11 Drawing Sheets

MACHINE FOR PRINTING IMAGES ON ARTICLES

This is a National Stage entry of Application No. PCT/EP03/03489 filed Apr. 3, 2003; the disclosure of which is incorporated herein by reference.

BACKGROUND OF THE INVENTION

The present invention relates in general to machines for printing images on articles such as containers or packages of products.

In the description and in the appended claims, the term "image": is intended in a broad sense to mean text, a design or logo, a bar code, or any other two-dimensional graphical representation.

It is known to print codes and/or images of other types directly onto already-packaged products by the thermal transfer of ink from an inked ribbon.

The subject of the present invention is, in particular, a type of machine for printing images comprising a support structure in which there are:

a thermal-transfer device having a movable active surface in a position operatively facing the path of the articles that are to receive the printing, supply and guide means suitable for advancing a flexible ribbon in steps along a predetermined route which extends partly between the active surface of the thermal-transfer device and the path of the articles, the flexible ribbon carrying, at predetermined intervals, on the face which is intended to face the articles, images formed with a thermally transferable ink, and drive means suitable for bringing about a movement of the active surface of the thermal-transfer device towards the ribbon and an article so as to press and heat the ribbon against the article in order to bring about the transfer of an image carried by the ribbon onto the article.

Typically, the movement of the thermal-transfer device towards the ribbon which carries the images and towards the article takes place vertically downwards from above.

If, during the vertical movement of the thermal-transfer device and of the portion of the ribbon which carries the image, even a slight slippage of the ribbon with the image takes place in a horizontal direction, a poor and sometimes unacceptable printing result is obtained.

SUMMARY OF THE INVENTION

An object of the present invention is to provide a printing machine of the type defined above which prevents this problem.

BRIEF DESCRIPTION OF THE DRAWINGS

Further objects, characteristics and advantages of the invention will become clear from the following detailed description which is given purely by way of non-limiting example with reference to the appended drawings, in which.

DETAILED DESCRIPTION OF THE INVENTION

Figure 1:
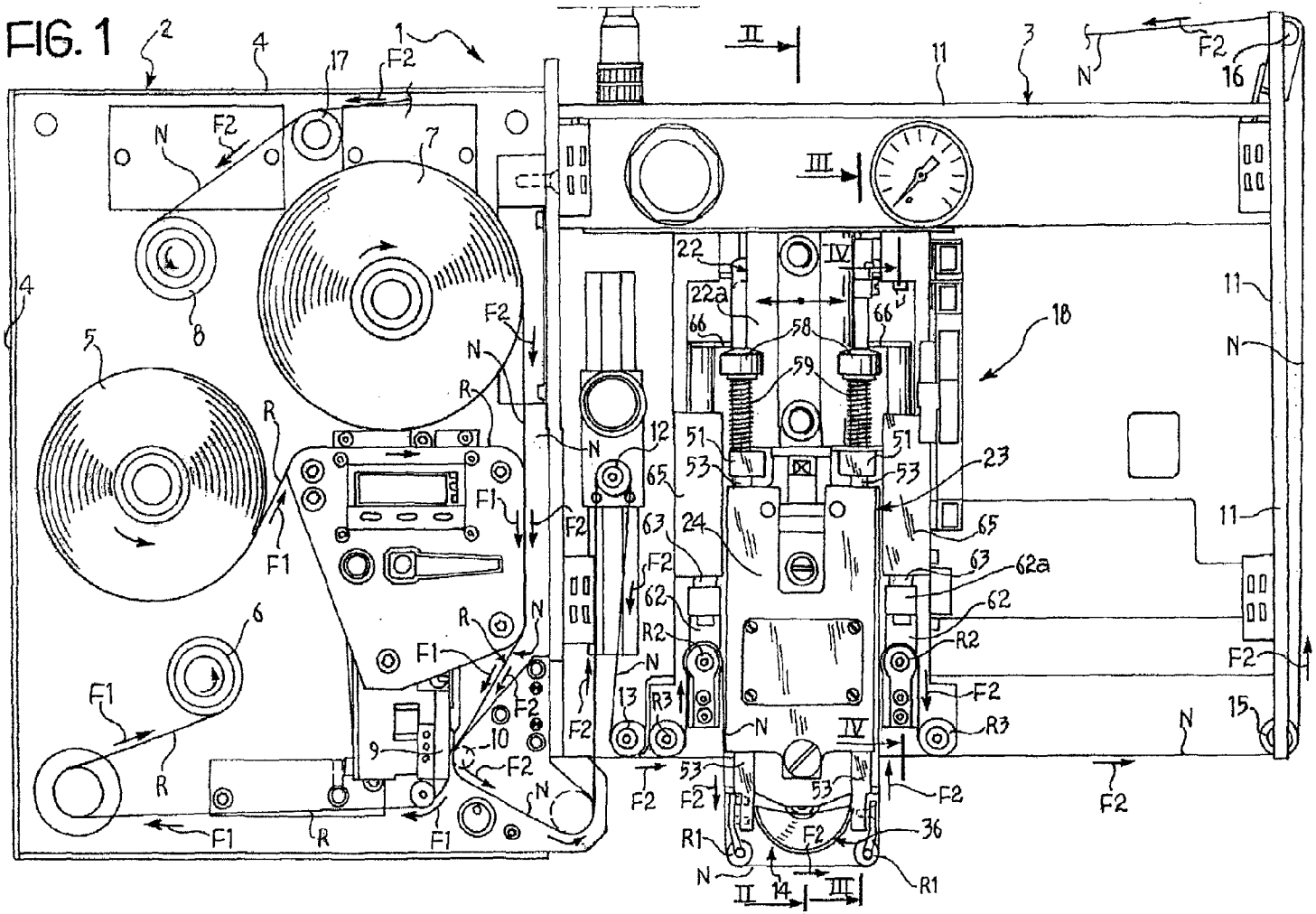
FIG. 1 is a front view of a first printing machine according to the present invention.

In the drawings, a thermal ink-transfer printing machine according to the invention is generally indicated 1.

With reference to FIG. 1 in particular, a printing machine 1 according to the invention comprises a section 2 for the supply and preparation of the printing ribbon and an adjacent section 3 for the transfer of the images onto the articles (which are not shown).

The sections 2 and 3 of the machine are advantageously formed so as to be connectible and disconnectible relative to one another.

The section 2 for the preparation and supply of the printing ribbon comprises a structure 4 in which, in known manner, there are a reel or bobbin 5 for the unwinding of a ribbon R which is inked on one face, and an associated motor-driven reel or bobbin 6 for rewinding the ribbon.

Starting from the unwinding reel 5, the inked ribbon R follows a route indicated by the arrows F1 and defined by a plurality of guide rollers.

Also provided in the support structure 4 of the section 2 of the machine are an unwinding reel or bobbin 7 for an auxiliary ribbon N or printing ribbon, and an associated motor-driven rewinding reel or bobbin 8.

Between the reels 7 and 8, the printing ribbon N follows a route indicated by the arrows F2.

Downstream of the reels or bobbins 5 and 7, the ribbons R and N travel along a portion of their respective routes in a juxtaposed condition, both at the same speed which is controlled in known manner.

In particular, the two ribbons R and N pass together between a printing head 9 and an associated counter-roller 10.

The printing head 9 is, for example, a thermal head of the dot-line type.

A controlled, selective transfer of thermally meltable ink from the inked ribbon R to the auxiliary ribbon N is brought about between the head 9 and the counter-roller 10.

Downstream of the printing head 9, the routes of the ribbons R and N separate; the used inked ribbon R continues towards the rewinding bobbin or reel 6 and the printing ribbon, with the images formed at predetermined intervals thereon, continues towards the section 3 of the machine which is intended to perform the transfer of the images onto the articles.

With reference in particular to FIG. 1, the section 3 of the printing machine 1 comprises a support framework 11 connected firmly to the support structure 4 of the section 2.

The section 3 of the printing machine 1 comprises an upper guide roller 12 with a substantially horizontal axis, mounted on a vertically translatable slide 12*a* for the ribbon N which comes, provided with the images to be printed, from the section 2 of the machine. Downstream of the roller 12 there is a further roller 13.

Downstream of the roller 13 the route of the ribbon N in the section 3 of the machine is defined substantially by three pairs of parallel and aligned guide rollers, the pairs being indicated R1, R2 and R3, respectively.

The rollers R1 have their respective axes lying in a common first, substantially horizontal plane and include between them, in front of a thermal-transfer device generally indicated 14, a portion of the ribbon N sufficient to contain an image to be printed.

As will become clearer from the following description, the guide rollers R1 are operatively movable vertically away from and towards the articles which are to receive the printing.

The rollers R2 of the second pair are arranged upstream and downstream of the rollers of the first pair R1, respectively, and are also aligned and parallel with one another as well as with the rollers of the first pair. The rollers R2 lie in a common, substantially horizontal plane. As will become clearer from the following description, the rollers R2 are also operatively movable vertically away from and towards the path of the articles which are to receive the printing.

The guide rollers R3 are disposed upstream and downstream of the rollers R2 but are fixed vertically.

The arrangement of the rollers R1, R2 and R3 is, in particular, such that the portions of the ribbon N included between the rollers R1 and the rollers R2 and the portions included between the rollers R2 and R3 are substantially parallel with one another and hence substantially vertical. When the ribbon N has left the guide roller R3 which is downstream of the thermal-transfer device 14, it returns towards the rewinding reel or bobbin 8, following a route defined by further deflecting rollers 15 and 16 of the section 3 of the machine and a deflecting roller 17 of the section 2.

Figure 2:
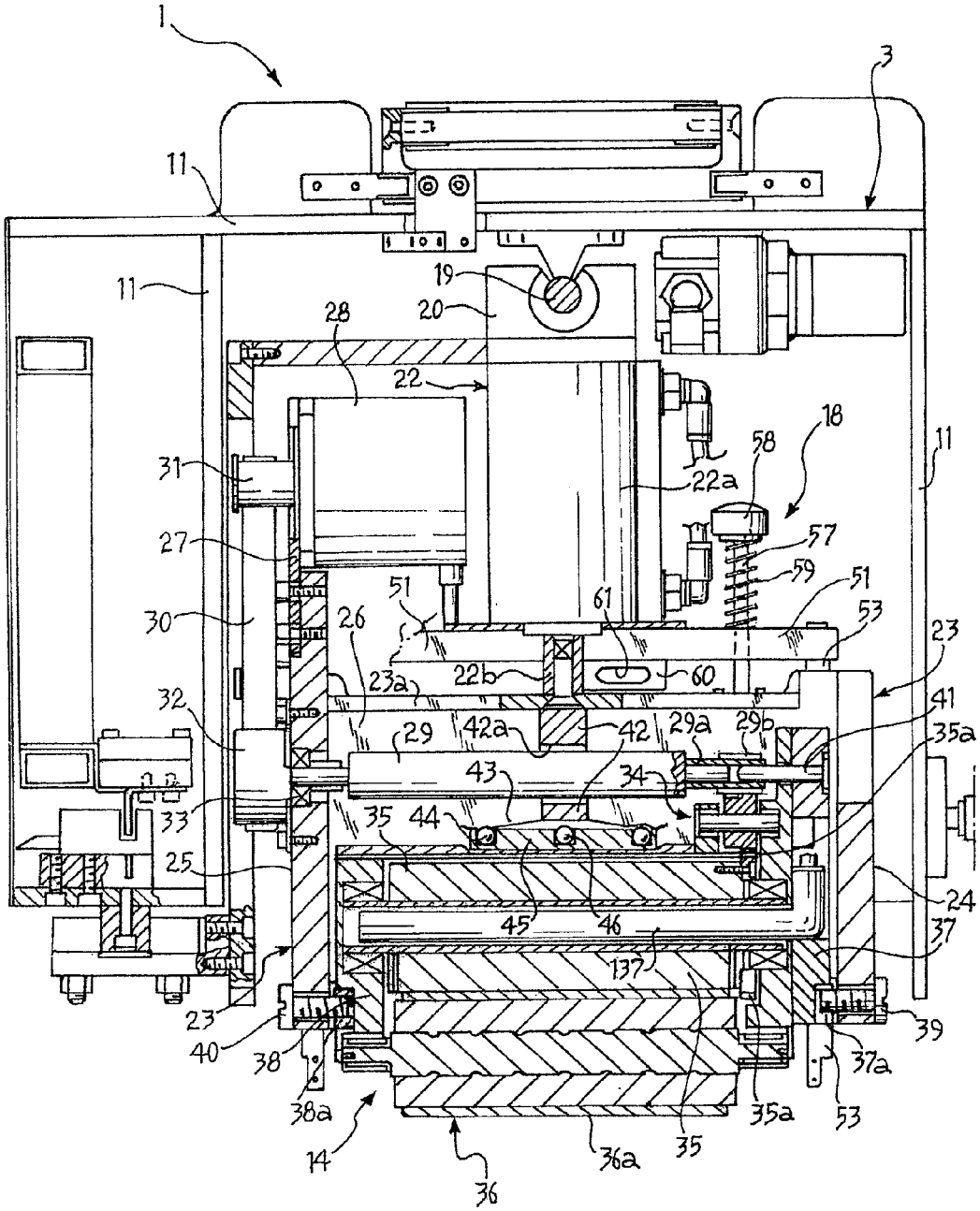
FIGS. 2, 3 and 4 are partial sections taken substantially on the lines II—II, III—III and IV—IV of FIG. 1.
Figure 4:
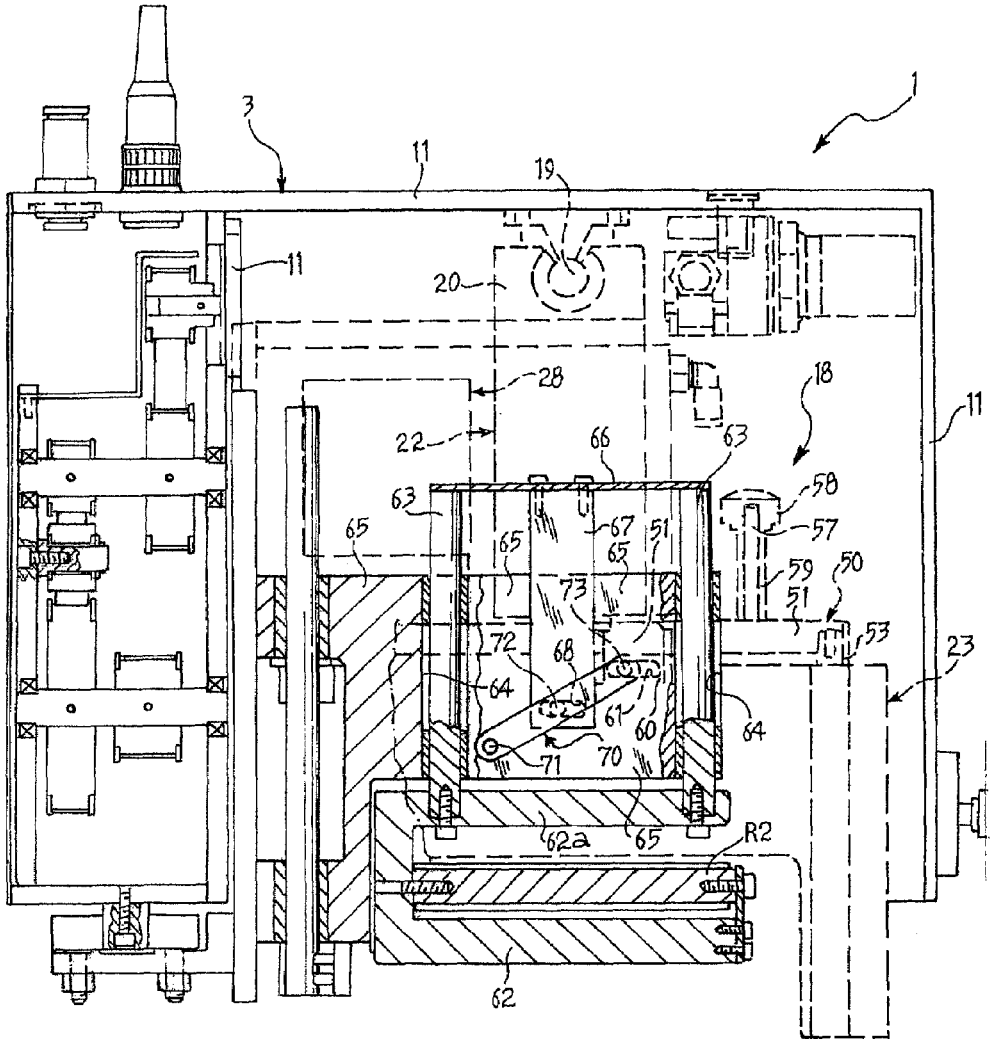

The device 14 for the thermal transfer of the images forms part of a more complex unit, generally indicated 18 in the drawings, which is translatable relative to the framework 11 of the section 3 of the machine along a horizontal guide indicated 19 in FIGS. 2 and 4. The unit 18 is connected, in particular, to a slide 20 which is translatable along the guide 19 under the action of an electric motor (not shown but of known type).

The unit 18 comprises a fluid cylinder 22, for example, a pneumatic cylinder. The cylinder has a body 22*a* the upper end of which is fixed to the slide 20. The rod 22*b* of the cylinder projects below the body 22*a* and is connected firmly to an upper cross-member 23*a* of a load-bearing structure, generally indicated 23 (see in particular FIG. 2).

Figure 3:
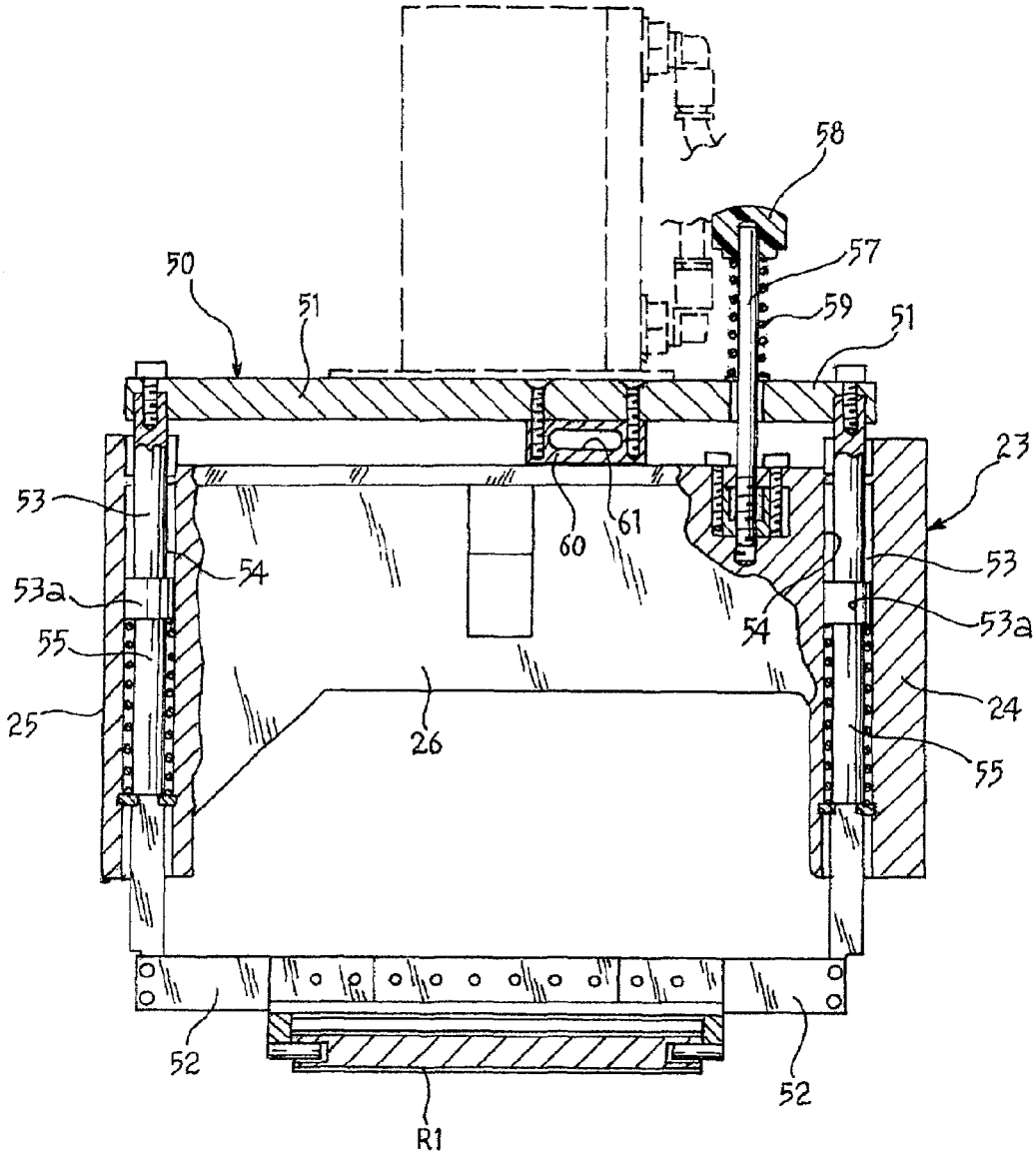

The load-bearing structure 23 has a substantially annular shape with a rectangular cross-section, with a vertical axis, with two shorter vertical side walls 24 and 25 and two longer vertical side walls 26 of which only one is visible in the drawings (FIG. 3).

As can be seen in particular in FIG. 2, the rear side wall 25 of the load-bearing structure 23 has an upper extension which projects upwards and to which an electric motor 28 with a horizontal axis is fixed by means of a connecting plate 27. The shaft of the electric motor 28 is coupled with a horizontal transmission shaft 29 by means of a transmission comprising a belt 30 stretched between a drive pulley 31 keyed to the shaft of the motor 28 and a driven pulley 32 keyed to one end of the transmission shaft 29.

As can be seen in FIG. 2, the transmission shaft 29 is supported in a substantially cantilevered manner by means of a ball bearing 33 mounted in a seat provided in the rear side wall 25 of the load-bearing structure 23. By virtue of this mounting, the transmission shaft 29 can perform limited pivoting movements about the axis of the bearing 33.

The end of the transmission shaft 29 facing the front wall 24 of the structure 23 is shaped as a tube 29*a* (FIG. 2) and carries externally a ring gear 29*b* which is coupled, by means of a series of gears generally indicated 34, with an external ring gear 35*a* of a heating roller 35 which forms part of the thermal-transfer device 14.

The heating roller 35 is mounted in close contact with an underlying rotatable transfer roller 36 which is intended positively to bring about the transfer onto underlying articles of the images that are carried by the ribbon N interposed therebetween.

A so-called resistive heating "cartridge" 137 is mounted axially in the heating roller 35 in known manner, for generating the necessary heat.

In operation, activation of the electric motor 28 brings about rotation of the transmission shaft 29 by means of the belt transmission 30–32. The transmission shaft 29 sets the heating roller 35 in rotation by means of the gears 29*b*, 34 and 35*a* and the hot surface of the heating roller 35 transfers heat onto the active outer surface 36*a* of the transfer roller 36.

The thermal-transfer device with the rollers 35 and 36 is advantageously substantially of the type described in the Applicant's European patent application EP-A-0 856 416.

The above-described components of the thermal-transfer device 14 are supported for rotation by a structure which comprises two end walls or plates 37 and 38 (FIG. 2) and which houses the load-bearing structure 23.

In the embodiment shown by way of example, the support structure of the thermal-transfer device 14 is supported by a pair of screws 39 and 40 (FIG. 2) which are screwed into the end walls 24 and 25 of the load-bearing structure 23 and the ends of which extend in slot-shaped notches formed in the lower edges of the walls or plates 37 and 38. A further screw 41, screwed through the wall 37, has a smooth end which fits into the tube-shaped end 29*a* of the transmission shaft 29.

A plate-like element connected rigidly to the movable rod 22*b* of the cylinder 22 is indicated 42 and has an opening 42*a* through which the transmission shaft 29 extends with ample clearance. A Belleville washer or bell spring 43 is fixed to the lower end of the element 42 and bears with its peripheral portion on a plurality of balls or spheres 44 mounted in a recessed seat of a disc 45 fixed to the support structure of the thermal-transfer device 14. A further ball or sphere 46 is carried centrally in a recess of the disc and its upper portion is normally spaced from the top portion of the Belleville washer 43.

The above-described arrangement is such that the thermal-transfer device 14 can easily be removed from the load-bearing structure 23 for repair or maintenance. For this purpose, it suffices to remove the screws 39–41, after which the thermal-transfer device 14 can easily be slid out of the load-bearing structure 23 through the lower end thereof.

The arrangement is also such that the thermal-transfer device 14 can perform limited pivoting movements relative to the load-bearing structure 23 so that if, during the initial stage of coupling with an underlying article (with the ribbon N interposed), the contact between the transfer roller 36 and the article does not take place perfectly on a generatrix of the roller, the device 14 as a whole can pivot slightly and this enables the contact to be improved appreciably.

As can be seen in particular in FIG. 3, each guide roller R1 is carried by a respective quadrilateral structure, generally indicated 50. This structure comprises an upper cross-member 51 and a lower cross-member 52 fixed to the upper ends and to the lower ends, respectively, of two pillars 53 that are mounted for sliding in respective ducts 54 formed in the load-bearing structure 23 in the vicinity of the lateral vertical corners thereof.

The pillars 53 have respective radial enlargements 53*a* in an intermediate region. Helical springs 55 are arranged around the pillars 53 between the respective enlarged portions 53*a* and radial stops 54*a* that are provided lower down in the associated seats or ducts 54. The springs 55 tend to urge the quadrilateral structure 50 upwards relative to the load-bearing structure 23.

The position of each quadrilateral structure 50 relative to the load-bearing structure 23 can be adjusted manually by means of a screw member 57 which extends with clearance through an opening in the upper cross-member 51 of the quadrilateral structure and is screwed into a threaded hole provided in the load-bearing structure 23. The screw member 57 is provided, at its upper end, with a knob-like grip 58 which facilitates its rotation.

Respective, very stiff, helical springs 59, in particular stiffer than the springs 55, are arranged between the knobs 58 and the associated cross-members 51 of the quadrilateral structures 50, around the screw members 57.

The adjustment of the position of the quadrilateral structures 50 relative to the load-bearing structure 23 is in any case such as generally to leave a small vertical clearance, for example of 5–6 mm, between the cross-members 51 of the quadrilateral structures and the structure 23.

Rotation of the knobs 58 and adjustment of the relative positions of the quadrilateral structures 50 in fact adjusts the position of the guide rollers. R1 relative to the transfer roller 36 of the thermal-transfer device 14 during the stage of the lowering of the roller 36 and of the contact with an underlying article. At rest, the arrangement is, for example, that shown in FIG. 1 in which the roller 36 is slightly raised, for example, by a distance of 5–6 mm, relative to the portion of the ribbon N which is disposed between the rollers R1.

It is pointed out that the relative position of each quadrilateral structure 50 is adjustable independently of that of the other. This consequently enables the position of each of the rollers R1 relative to the transfer roller 36 to be adjusted independently of that of the other roller R1.

A plate which is fixed beneath the cross-member 51 of each of the quadrilateral structures 50 is indicated 60 in FIGS. 2 and 3. Each plate 60 has a respective, substantially horizontal, slot-like opening 61.

With reference now to FIG. 4 in particular, each upper guide roller R2 is mounted rotatably in a substantially U-shaped structure 62 arranged lying down, that is, a horizontally elongated C-shaped structure. The lower end of a corresponding pair of pillars 63 is connected to the upper horizontal arm 62*a* of each of the structures 62; the pillars 63 extend slidably in corresponding ducts 64 formed in two walls or plates 65 fixed to the framework 11 of the section 3 of the printing machine (see also FIG. 1).

The pillars 63 of each pair are interconnected at the top by a rigid horizontal structure 66. A plate 67, fixed firmly to this structure (FIG. 4), extends vertically downwards and terminates forming a substantially horizontal opening or slot 68.

As can be seen in FIG. 4, a lever 70 is mounted at a fulcrum 71 on each stationary wall or plate 65 so as to be pivotable about a substantially horizontal axis. Each lever 70 has an intermediate transverse pin 72 which extends through the slot 68 of a plate 67 and an end pin 73 which extends through the slot 61 of the plate 60 fixed to one of the above-described quadrilateral structures 50. The distance of the pin 73 from the fulcrum 71 is twice the distance of the pin 72 from that fulcrum.

The levers 70 enable the magnitudes of the vertical movements of the rollers R2 to be linked with those of the rollers R1 on the basis of a very precise relationship, that is, in a ratio of 1:2.

The above-described printing machine operates in the following manner.

In the section 2 of the machine, the ribbons R and N are moved in steps. Upon each step, the printing head 9 transfers an image formed by thermally meltable ink from the inked ribbon R to the ribbon N.

A new image, carried by the ribbon N on its downwardly-facing face, is correspondingly presented in front of the transfer roller 36 between the guide rollers R1 upon each step.

The control system of the machine then brings about activation of the cylinder 22 and downward movement of its rod 22*b*. The rod urges downwards the entire load-bearing structure 23 and the thermal-transfer device 14 connected thereto.

After a first travel corresponding to the vertical clearance between the cross-members 51 and the structure 23, the downward movement of the load-bearing structure 23 also brings about downward movement of the quadrilateral structures 50 to the bottom of which the guide rollers R1 are connected.

The transfer roller 36 is thus brought into contact with the upper face of the portion of ribbon N included between the rollers R1.

The control system of the machine 1 then brings about a translation of the unit generally indicated 18, in a horizontal direction. During this stage, the transfer roller 36, which is heated as a result of the rotational contact with the heating roller 35, performs the thermal transfer of the image from the ribbon N onto the underlying article. The peripheral velocity of the roller 36 is advantageously equal to the speed of translation of the unit 18.

It should be noted that, during the image-transfer stage, the portion of the ribbon N that is engaged by the transfer roller 36 is stationary locally and, in particular, is not subjected to any horizontal movement. This is permitted by the particular arrangement of the guide rollers R1, R2 and R3 and by the transmission with a ratio of 1:2 which links the vertical movements of the rollers R2 and R1.

Upon completion of the thermal transfer of the image, the control system of the machine causes the support structure 23 to be raised again by means of the cylinder 22. During this stage, first of all the thermal-transfer device 14 is raised and then the guide rollers R1 and R2 are raised. The machine thus tends to return to the configuration shown in FIG. 1.

The fact that the vertical positions of each of the rollers R1 can be adjusted independently enables one of them optionally to be kept slightly higher than the other. This may be advantageous, according to the characteristics of the ribbons N used, to facilitate detachment of the ribbon from the article after the transfer of an image.

The control system of the machine can then bring about the return of the unit 18 to the starting position and, at the same time, the execution of a further step (the formation of a new image). The operation continues in the manner described above.

FIGS. 5 to 12 show another printing machine according to the present invention. In these drawings, parts and elements identical or substantially equivalent to parts and elements already described above have again been given the same reference numerals or letters.

In the machine according to FIGS. 5–12, the section 2 for the preparation and supply of the printing ribbon N provided with images is substantially identical to the section 2 of the machine described above with reference to FIGS. 1 to 4.

Figure 5:
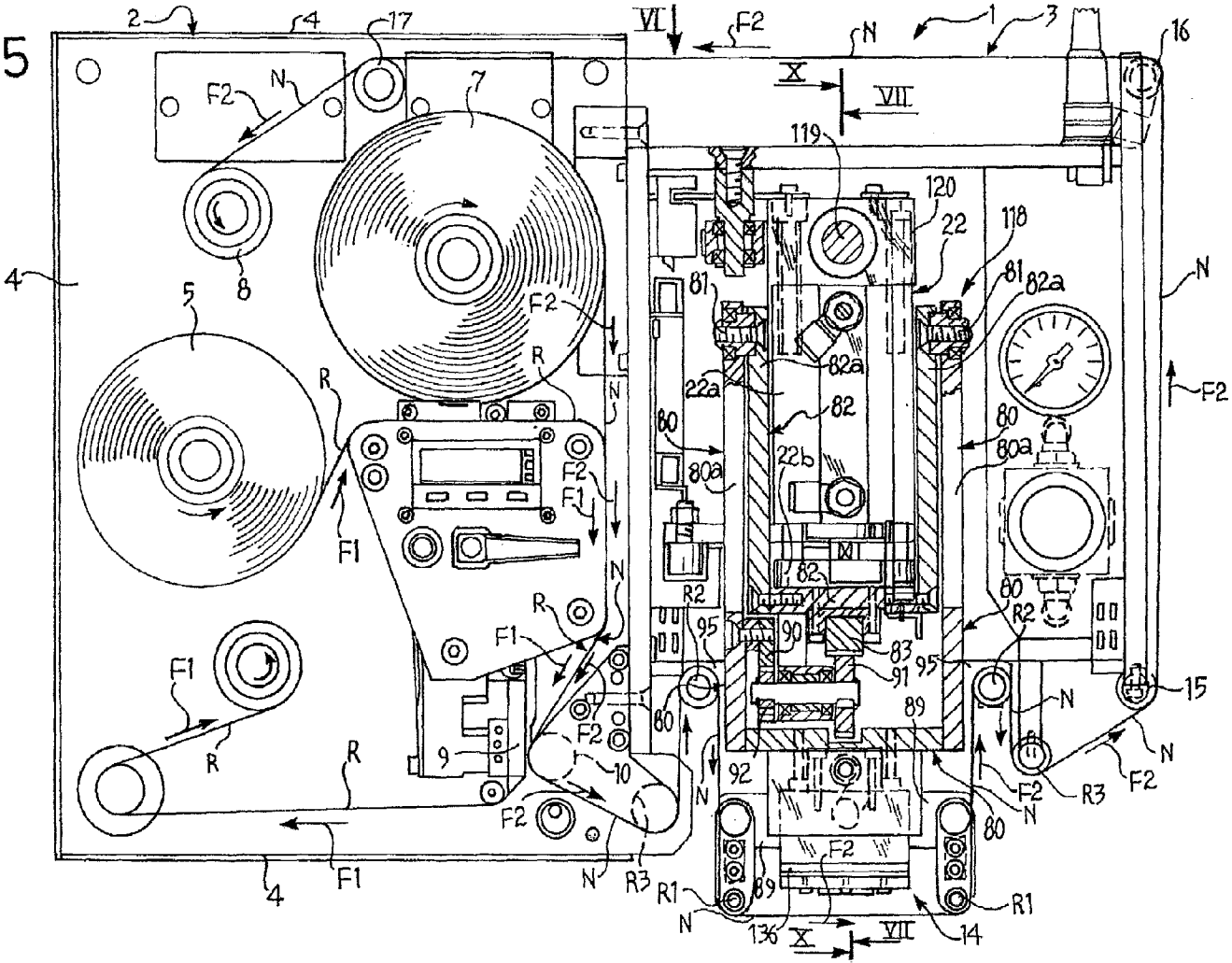
FIG. 5 is a front view of another printing machine according to the present invention.
Figure 6:
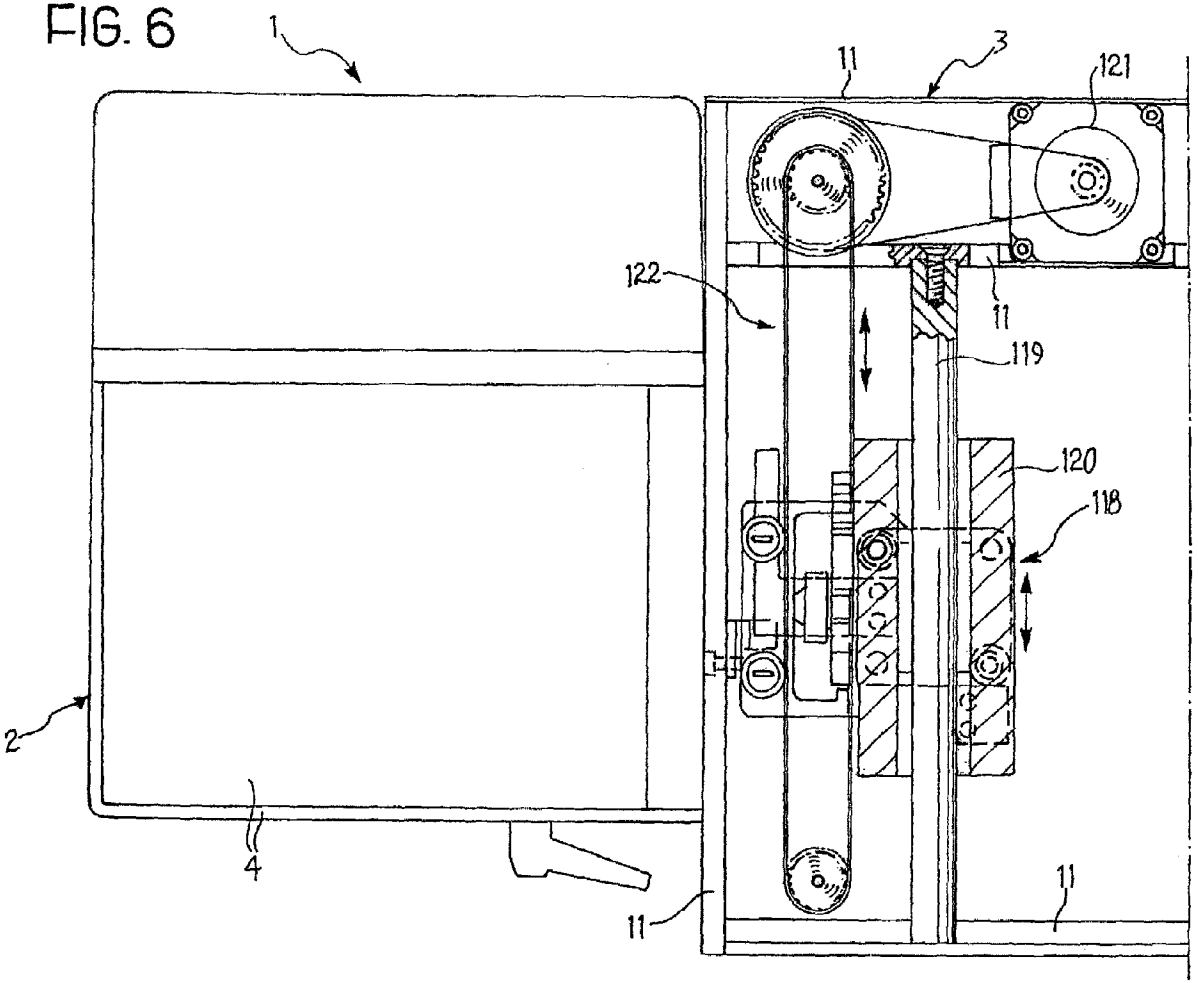
FIG. 6 is a partial view from above, taken on the arrow VI of FIG. 5.

The machine according to FIG. 5 is thus distinguished substantially with regard to the section 3 for the thermal transfer of the images.

In the machines according to FIG. 5, et seq. the section 3 comprises a movable unit generally indicated 118, connected to a slide 120 mounted so as to be translatable along an upper guide bar 119. As can be seen in particular in FIG. 6, the guide bar 119 extends transversely.

The movement of the slide 120 and of the associated movable unit 118 is brought about by means of an electric motor 121 (FIG. 6) and of an associated belt or chain transmission and respective pulleys, generally indicated 122.

The thermal-transfer device 14 comprises a heated pad 136 in which a so-called resistive heating cartridge 137 is incorporated in known manner.

Figure 7:
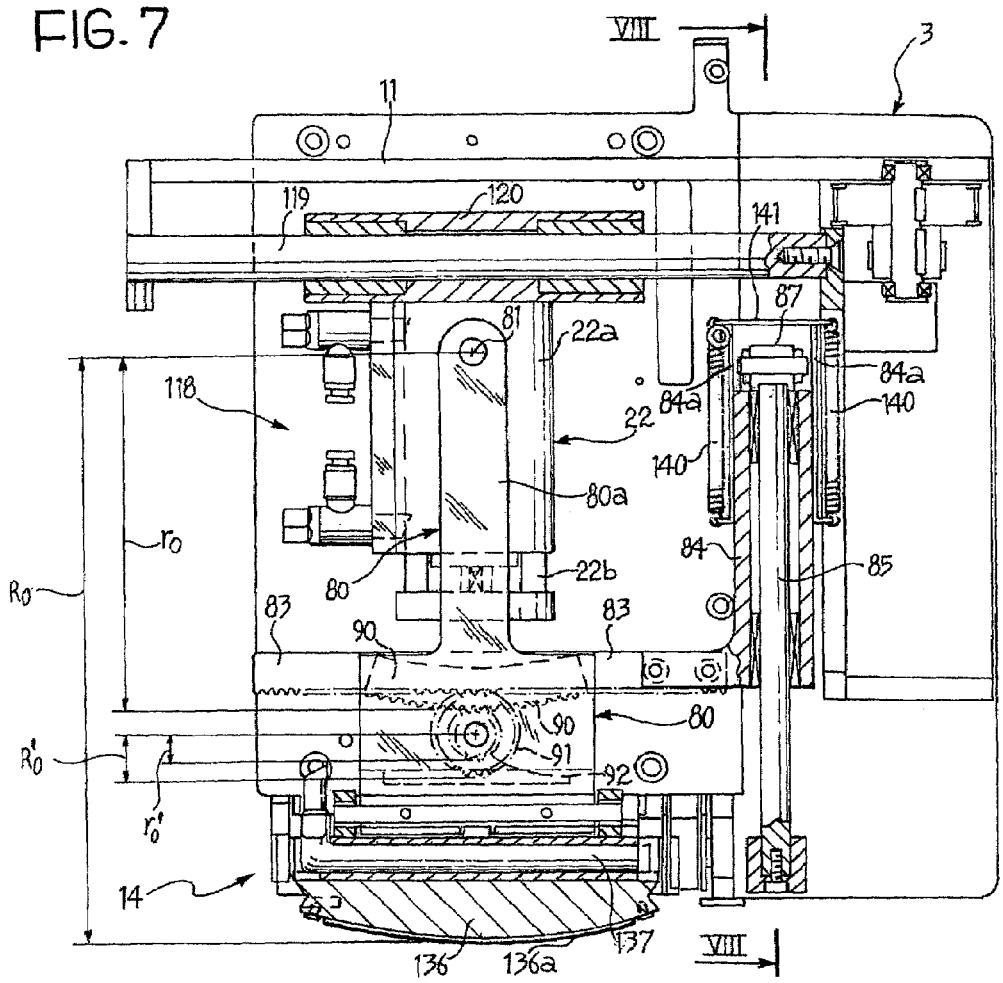
FIG. 7 is a partial section taken substantially on the line VII—VII of FIG. 5.

The pad 136 has an arcuate lower surface or face 136*a* the convex side of which faces downwards (see, for example, FIG. 7).

The pad 136 is fixed to a substantially fork-like body 80 having two parallel portions or arms 80*a* which extend vertically upwards (again see FIG. 7). The arms 80*a* of the body 80 are articulated at 81 to the upper ends of two arms 82*a* of a similar fork-shaped body 82 fixed to the movable portion 22*b* of the cylinder 22 (FIG. 5).

The articulation axis 81 of the shaped body 80 extends substantially horizontally and represents the axis of the cylinder on which the arcuate surface 136*a* of the thermal-transfer pad 136 theoretically extends. The radius of this cylinder is indicated $R_0$ in FIG. 7.

A linear rack, indicated 83 (FIGS. 5, 7, 8–12) is fixed (in the manner shown in FIG. 5) to the movable portion 22*b* of the cylinder 22. This rack 83, which has its teeth facing downwards, is also connected (FIGS. 7–12) to a vertical sleeve 84, slidable along a guide 85.

The guide 85 is in turn connected to similar guides 86 (FIGS. 8 and 9) by means of an upper cross-member 87 in which a horizontal slot-shaped opening 88 is formed. The guides 85 and 86 are fixed, at the bottom, to a cross-member 89 to which the guide rollers R1 are in turn connected.

As can be seen in FIG. 7, two springs 140 are stretched between an engagement provided in the intermediate portion of the sleeve 84 and a crosspiece 141. This crosspiece 141 bears on two upper extensions 84*a* of the sleeve 84. In the condition shown in FIG. 7 (pad 136 raised), the crosspiece 141 is disposed at a predetermined distance (for example 5–6 mm) from the underlying cross-member 87.

A further rack having a convex arcuate shape with the teeth also facing downwards is indicated 90 (FIGS. 5, 7 and 10–12). The arcuate rack 90 is fixed to the body 80 which carries the heating pad 136, as shown in FIG. 5.

As can be seen, for example, in FIG. 7, the straight rack 83 meshes with a sprocket 91 coaxial with a sprocket 92 of smaller diameter.

The sprockets 91 and 92 are carried rotatably by the body 82 which is fixed to the movable portion 22*b* of the cylinder 22 (see FIG. 5).

The arcuate rack 90 has a radius indicated $r_0$ in FIG. 7. The centre of curvature of this rack lies on the axis of pivoting 81 of the body 80 which carries the heating pad 136.

The sprockets 91 and 92 have respective radii ($R'_0$ and $r'_0$) which are in the same proportion to one another as the radii $R_0$ and $r_0$, that is: $R_0:r_0=R'_0:r'_0$.

In operation, a translation of the slide 120 along the guide 119 causes the sprockets 91 and 92 to roll on the associated racks 83 and 90. By virtue of the above-defined geometrical relationship between the radii, the translation of the slide 120 and of the cylinder 122 fixed firmly thereto leads to pivoting of the body 80 and of the associated heating pad 136 about the axis 81, as can be seen by a comparison of FIG. 10 and FIG. 11 or FIG. 12. The pivoting of the body 80 and of the pad 136 is, in particular, such that, at every moment, the active end surface 136*a* of the pad is tangential to a horizontal plane at a point (or rather along a line) which is vertically aligned with the pivoting axis 81.

In other words, the pad 136 pivots about the axis 81 as if the pad were a "sector" of a wheel of radius $R_0$ having its centre on the axis 81.

The upper guide rollers R2 in the machine of FIG. 5 et seq. are carried by a horizontal structure 95 (FIGS. 5, 8 and 9) which is connected to the lower ends of two vertical bars or pillars 96 which are translatable vertically in guided manner and are interconnected at the top by a transverse structure 97.

Figure 9:
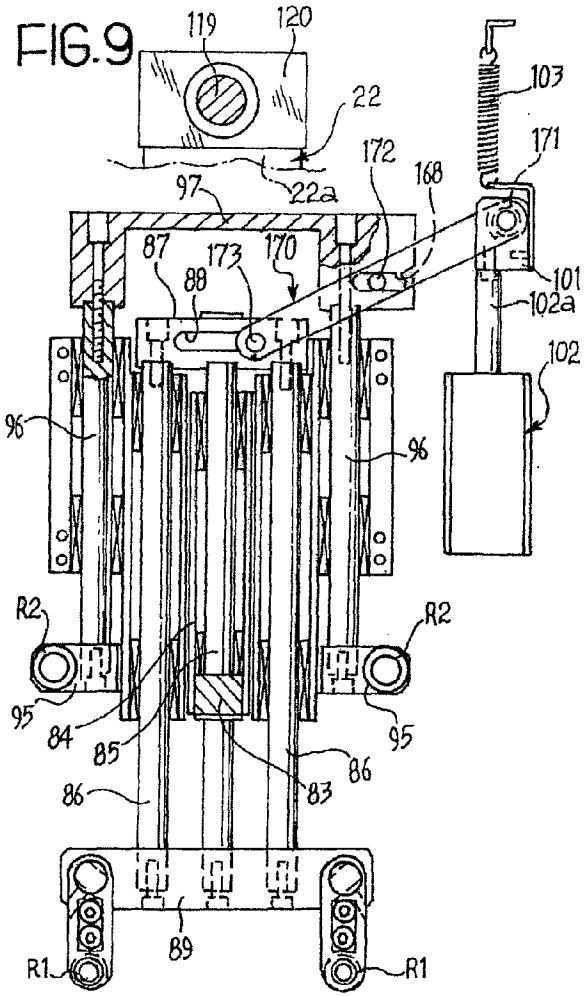
FIG. 9 is a partial view similar to that of FIG. 8 which shows some of the devices of the machine in a different operative condition.
Figure 8:
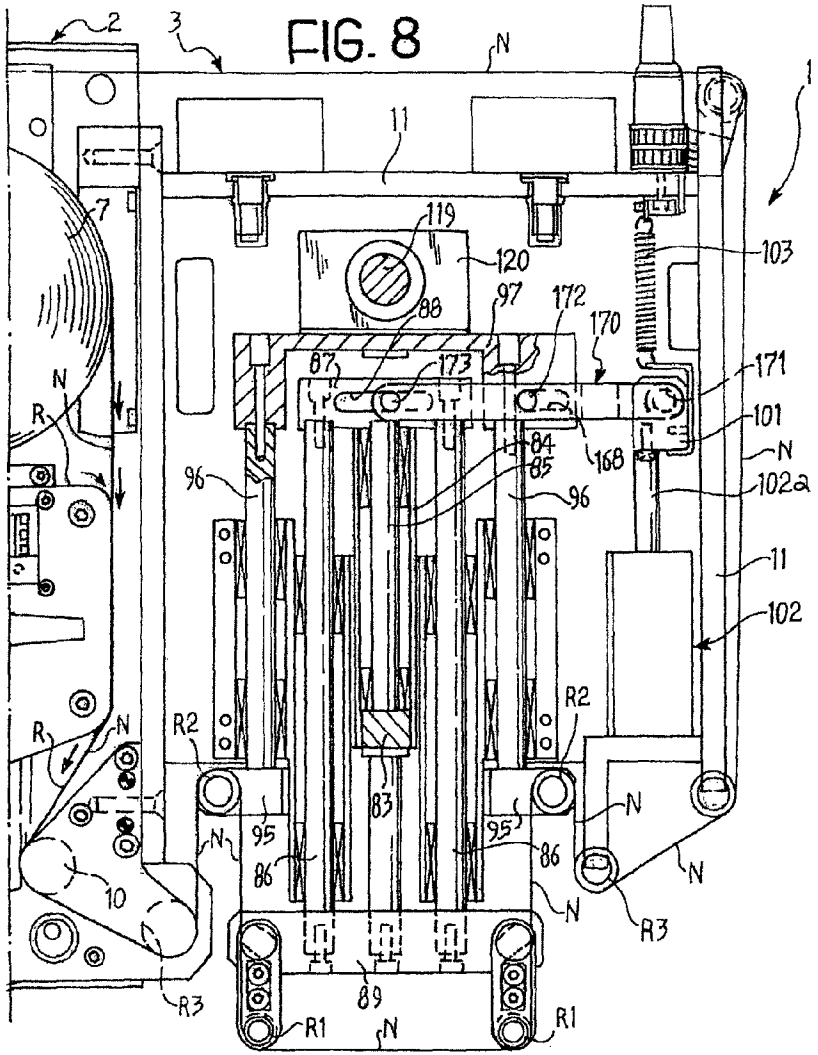
FIG. 8 is a partial section taken substantially on the line VIII—VIII of FIG. 7.

A lever, indicated 170 in FIGS. 8 and 9, has one end articulated at a fulcrum 171 and has, in its intermediate region, a transverse pin 172 which extends through a horizontal slot-like opening 168 of the cross-member 97. The lever 170 has, at its free end, a further transverse pin 173 which engages in the horizontal slot-like opening 88 of the cross-member 87. The distance between this pin 173 and the fulcrum 171 is twice the distance between the pin 172 and the fulcrum.

In operation, a downward movement of the movable portion 22*b* of the cylinder 22 brings about lowering of the bodies 82 and 80 and hence of the thermal-transfer pad 136. At the same time, corresponding lowering of the straight rack 83 and of the associated vertical sleeve 84 is brought about. After an initial downward travel of a magnitude equal to the distance between the crosspiece 141 and the cross-member 87, the further downward movement of the sleeve 84 causes the pillars 85 and 86 and the associated cross-members 87, 89 to be carried along, bringing about corresponding lowering of the lower guide rollers R1.

The distal end of the lever 170 thus performs a downward pivoting movement about the fulcrum 171 and, by means of its intermediate pin 172, brings about lowering of the structure formed by the pillars 96 and by the cross-members 97 and 95, as well as of the associated upper guide rollers R2, by a distance which is half that of the lowering of the lower guide rollers R1.

This enables the portion of the ribbon N which is disposed between the guide rollers R1 to be kept substantially stationary in a horizontal direction.

As soon as the heating pad 136 has performed its downward movement, the control system of the machine brings about translation of the slide 120 along the guide 119. This leads to pivoting of the pad 136 about the axis 81, as described above. The heating pad 136 thus performs a rolling movement in a transverse direction on the portion of the ribbon N which is interposed between the pad 136 and an underlying article.

Figure 10:
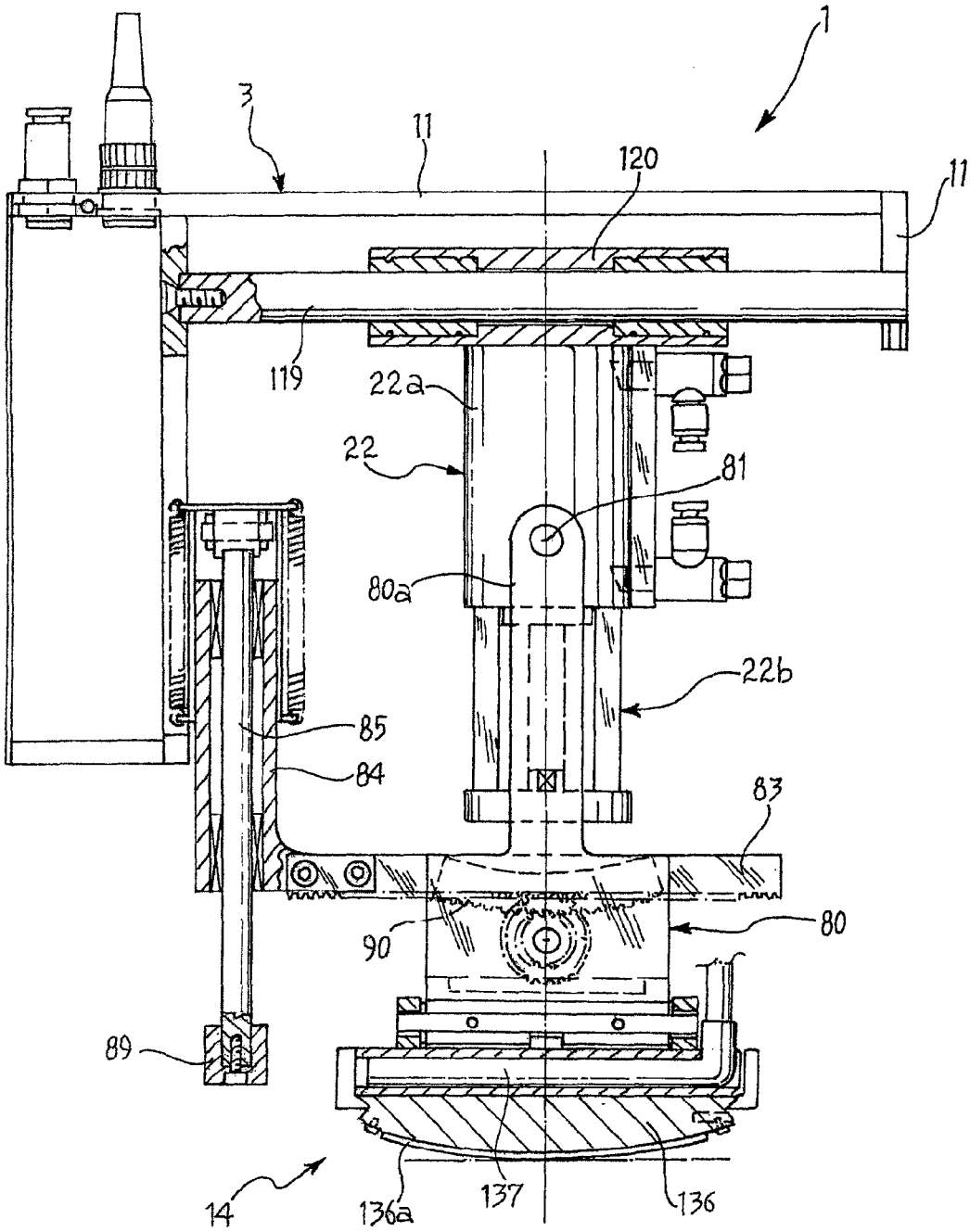
FIG. 10 is a partial section taken substantially on the line X—X of FIG. 5, and FIGS. 11 and 12 are partial views similar to that shown in FIG. 10 and show different operating conditions of the machine.
Figure 11:
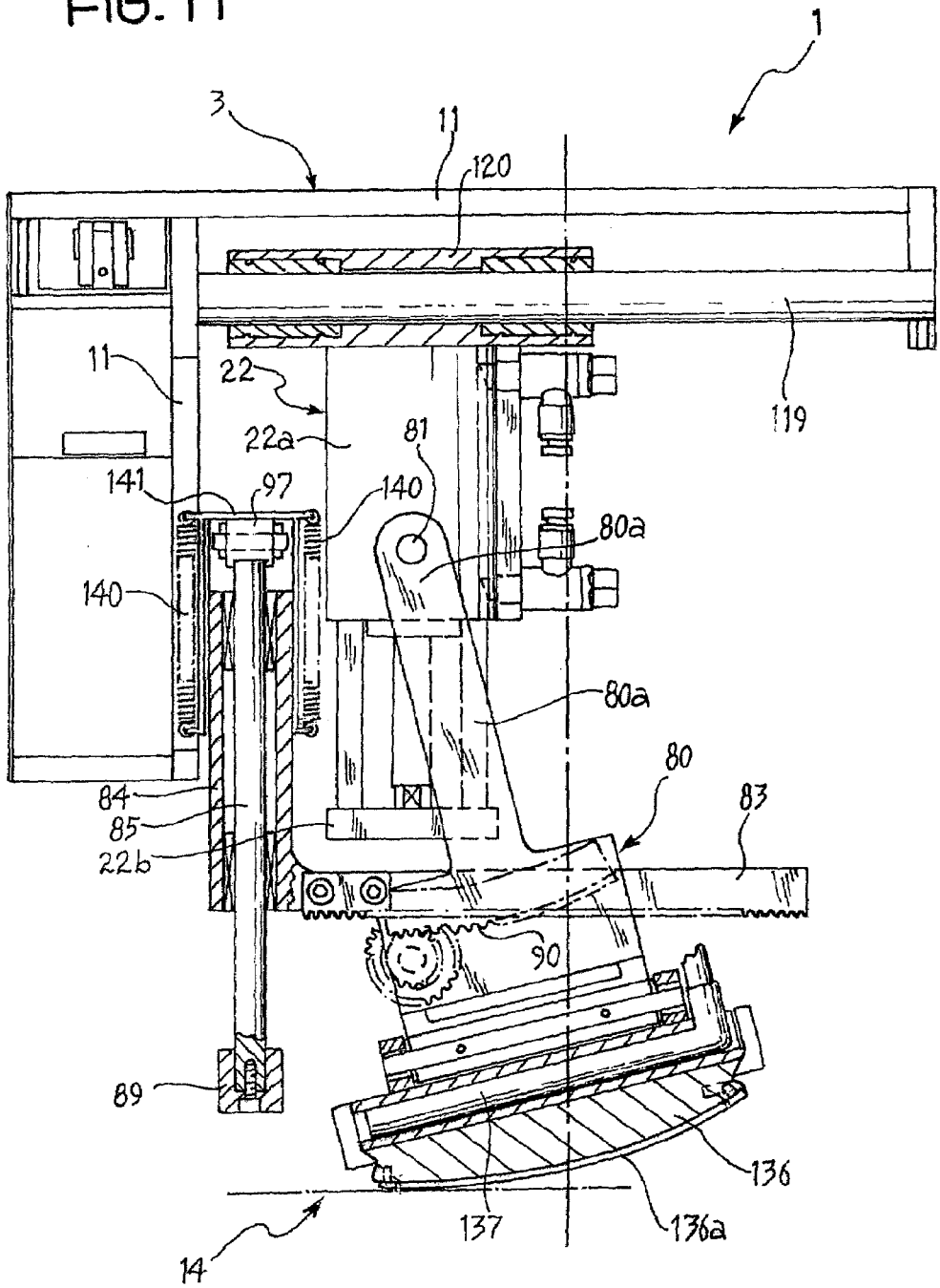
Figure 12:
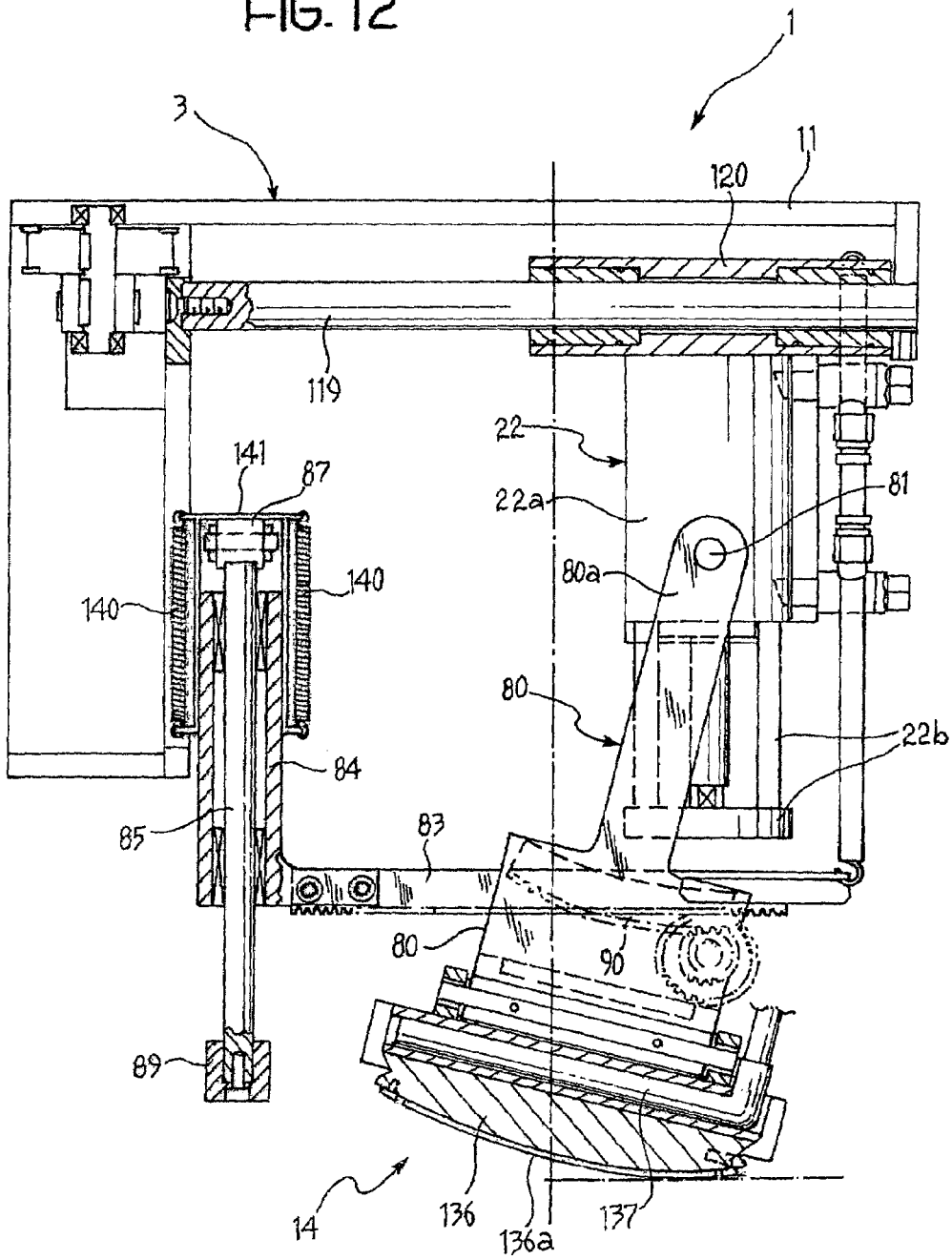

Naturally, the control system of the machine can be arranged to start this rolling movement from an extreme position such as the position of FIG. 11 or FIG. 12, or from an intermediate position such as that shown in FIG. 10.

Advantageously, as shown in FIGS. 8 and 9, the fulcrum 171 about which the lever 170 is articulated is not constantly stationary relative to the load-bearing structure 11 of the printing machine but rather is carried by a body 101 fixed to a rod 102*a* of a pneumatic cylinder 102 fixed to the structure of the machine. The cylinder 102 is normally kept in the condition shown in FIGS. 8 and 9 by the supply of a suitable fluid pressure to the interior of its body.

Each time the printing of an image on an article is completed, the control system of the machine can advantageously bring about the discharge of the pressure in the cylinder 102 so that the rod 102*a* can descend, bringing the fulcrum 171 of the lever 170 with it, although in opposition to a weak spring 103.

When the control system of the printing machine causes the movable portion 22*b* of the main cylinder 22 and the pad 136 connected thereto to be raised, the guide rollers R2 are braked in their upward movement if the ribbon N is adhering to the article. In this case, the rollers R2 "brake" the intermediate pin 172, whereas the pin 173 can continue to rise. The fulcrum 171, which is no longer blocked by the cylinder 102, is consequently lowered. A pull is thus exerted on the opposite ends of the portion of the ribbon N from which the image just printed has been transferred. The two edge portions of the portion of the ribbon N just used are thus pulled in directions tending gradually ever more towards the vertical and this renders the pulling action exerted on this portion of the ribbon more effective and the ribbon can therefore easily be detached from the article.

Upon completion of the cycle, that is, when the movable portion 22*b* of the cylinder 22 has returned to the raised, starting position, taking the rollers R1 with it, the control system reapplies the pressure to the cylinder 102 which returns the fulcrum 171 to the normal position. This causes the rollers R2 to rise, forcing the ribbon N to be detached from the article if this has not already occurred.

Naturally, the principle of the invention remaining the same, the forms of embodiment and details of construction may be varied widely with respect to those described and illustrated purely by way of non-limiting example, without thereby departing from the scope of the invention as defined in the appended claims.

Thus, for example, as an alternative to the method described above, the images may be arranged on the printing ribbon N by one of the various other known methods, for example, those described in the Applicant's European patent application EP-A-0 572 999.

What is claimed is:

1. A machine (1) for printing images on articles, comprising a support structure (4, 11) having:

a thermal-transfer device (14) having a movable active surface (36*a*; 136*a*) in a position operatively facing the path of the articles;

supply and guide means (5–10) suitable for advancing a flexible ribbon (N) in steps along a predetermined route which extends partly between the active surface (36*a*; 136*a*) of the thermal-transfer device (14) and the path of the articles, the flexible ribbon (N) carrying, at predetermined intervals, on the face which is intended to face the articles, images formed with a thermally transferable ink, and drive means (22) suitable for bringing about a substantially vertical movement of the active surface (36*a*; 136*a*) of the thermal-transfer device (14) towards the ribbon (N) and an article so as to press and heat the ribbon against an article in order to bring about the transfer of an image carried by the ribbon (N);

the machine (1) being characterized in that the supply and guide means comprise:

a first pair of aligned, movable guide rollers (R1) which are disposed on the route of the ribbon (N), upstream and downstream of the thermal-transfer device (14), respectively, with their respective axes lying substantially in a common, first plane, and which can include between them a portion of the ribbon (N) containing an image, in front of the active surface (36*a*; 136*a*) of the thermal-transfer device (14), the rollers (R1) being operatively movable away from and towards the path of the articles along a predetermined axis which is arranged at an angle to the plane that contains the axes of the rollers (R1);

a second pair of movable guide rollers (R2), which are disposed upstream and downstream of the first pair of rollers (R1), are aligned and parallel with one another and with the rollers of the first pair (R1) and lie in a common, second plane which is substantially parallel to the first plane, the second pair of rollers (R2) being operatively movable away from and towards the path of the articles along the predetermined axis; and a third pair of stationary and aligned guide rollers (R3), which are disposed upstream and downstream of the second pair of rollers (R2) and are parallel with one another and with the rollers of the first and second pairs (R2, R2);

the arrangement of the pairs of rollers (R1, R2, R3) being such that the portions of the ribbon (N) which are included between the first and second pairs of rollers (R1, R2) and the portions which are included between the second and third pairs of rollers (R2, R3) are substantially parallel with one another;

there being associated with the first and with the second pair of guide rollers (R1, R2) movement means (70; 170) such that a movement of the second pair of rollers (R2) along the predetermined axis is substantially equal to half of the corresponding movement of the first pair of rollers (R1).

2. A machine according to claim 1 in which the first pair and the second pair of movable guide rollers (R1, R2) are carried, respectively, by a first movable support structure and by a second movable support structure (50, 62–67; 84–87, 95–97) which are coupled with one another mechanically by means of a lever (70; 170) that is pivotable relative to a fulcrum (71; 171) in the support structure (4) of the machine (1), the movable support structures being connected to points (72; 73; 172, 173) of the lever (70; 170) which are disposed, relative to the fulcrum (71, 171), at distances which are in a ratio of 2:1 relative to one another.

3. A machine according to claim 1 in which the thermal-transfer device (14) is mounted removably in a load-bearing structure (23) that is movable under the action of the drive means (22), the thermal-transfer device (14) comprising a motor-driven heating roller (35) that is rotatable in contact with an adjacent transfer roller (36), the heating roller (35) being rotatable about a stationary resistive heating device (137).

4. A machine according to claim 3 in which the heating roller (35) comprises a central tube arranged so as to be rotatable about the resistive heating device (137) and supported at its ends by means of bearing devices, the roller (35)

having a ring gear (35*a*) suitable for enabling it to be rotated by drive means (28–32) mounted on the movable load-bearing structure (23).

5. A machine according to claim 4 in which the drive means comprise an electric motor (28) coupled to a first end of a transmission shaft (29) which has one end mounted so as to be rotatable relative to the movable load-bearing structure (23) and the other end (29*b*) coupled to the heating roller (35).

6. A machine according to claim 5 in which the transmission shaft (29) is supported in the movable load-bearing structure (23) in a cantilevered manner with a capability for pivoting.

7. A machine according to claim 6 in which the unit formed by the heating roller (35) and the associated transfer roller (36) is mounted in the movable load-bearing structure (23) with the capability to perform limited pivoting movements.

8. A machine according to claim 2 in which each roller (R1) of the first pair and each roller (R2) of the second pair is carried by a respective movable support structure (50; 62–67).

9. A machine according to claim 8 in which each movable support structure associated with a guide roller (R1) of the first pair is provided with respective adjustment means (57–59) suitable for permitting independent adjustment of its position relative to that of the above-mentioned movable load-bearing structure (23).

10. A machine according to claim 1 in which drive means (119–122; 83, 90, 91, 92) are associated with the thermal-transfer device (14; 136) for bringing about a rolling movement thereof in a direction transverse the direction of advance of the printing ribbon (N).

11. A machine according to claim 10 in which the thermal-transfer device (14) comprises a heated pad (136) mounted for pivoting about an axis (71) that is translatable transversely relative to the structure (11) of the machine (1), the pad (136) having an active end surface (136*a*) which is arcuate and convex and lies substantially on a cylinder the axis of which coincides with the axis (81) of pivoting of the pad (136), the drive means being arranged in a manner such that, at every moment during a pivoting movement of the pad (136), its active surface (136*a*) is tangential to a horizontal plane along a line that is aligned vertically with the axis of pivoting (81).

12. A machine according to claim 11 in which the drive means comprise a linear rack (83) which is movable vertically and is stationary horizontally, and with which is meshed a first sprocket (91) fixed firmly to and coaxial with a second sprocket (92) which meshes with an arcuate rack (90) that is fixed firmly to the pad (136) and is centred about the axis of pivoting (81) of the pad (136), the arrangement being such that the ratio between the radius of the first sprocket (91) and the radius of the second sprocket (92) is substantially equal to the ratio between the radius of the active surface (136*a*) of the pad (136) and the radius of the arcuate rack (90).

13. A machine according to claim 2 in which controllable means (102) are provided for permitting a movement of the fulcrum (171) of the lever (170).

* * * * *